United States Patent [19]

Mendehall

[11] Patent Number: 4,522,498

[45] Date of Patent: Jun. 11, 1985

[54] ASPHALTIC CONCRETE RECYCLE APPARATUS AND METHOD

[76] Inventor: Robert L. Mendehall, 1770 Industrial Rd., Las Vegas, Nev. 89102

[21] Appl. No.: 139,708

[22] Filed: Apr. 14, 1980

Related U.S. Application Data

[63] Continuation-in-part of Ser. No. 871,351, Jan. 23, 1978, Pat. No. 4,208,131, and Ser. No. 906,734, May 17, 1978, Pat. No. 4,240,754.

[51] Int. Cl.[3] ..... B28C 5/46

[52] U.S. Cl. ..... 366/4; 366/25; 366/57; 366/228

[58] Field of Search ..... 366/4, 5, 7, 11, 12, 366/24, 25, 56–58, 68, 225, 228; 432/72, 73, 432/105; 99/473. 480, 481

[56] References Cited

U.S. PATENT DOCUMENTS

| | | | |
|---|---|---|---|
| 2,492,792 | 12/1949 | Ford | 366/25 |
| 2,952,452 | 9/1960 | Kopf | 99/473 |
| 3,817,697 | 6/1974 | Parobek | 432/105 |
| 3,884,213 | 5/1975 | Smith | 99/473 |
| 4,039,171 | 8/1977 | Shearer | 366/25 |
| 4,130,364 | 12/1978 | Brown | 366/4 |
| 4,136,965 | 1/1979 | Sunnergren et al. | 366/25 |

*Primary Examiner*—Timothy F. Simone
*Attorney, Agent, or Firm*—Seiler, Quirk & Tratos

[57] ABSTRACT

An apparatus for recycling asphaltic concrete comprises an elongated rotatable drum in which composition is introduced at a first end and recovered at the opposite second end, and having a burner extending into the drum so that the burner nozzle is located within the drum intermediate the first and second ends and directs the hot gases toward the first end, and wherein the portion of the drum between the burner and the first end is provided with lifters of a type which prevent the formation of a veil of composition particles from falling through the hot gases of combustion as the drum is rotated, and a second portion between the burner nozzle and the second drum end and which is provided with lifters which cause a veil of composition particles to pass through hot gases of combustion as the drum rotates.

6 Claims, 3 Drawing Figures

ASPHALTIC CONCRETE RECYCLE APPARATUS AND METHOD

REFERENCE TO OTHER APPLICATIONS

This application is a continuation-in-part of my copending applications Ser. No. 871,351, filed Jan. 23, 1978, U.S. Pat. No. 4,208,131 and 906,734, filed May 17, 1978, U.S. Pat. No. 4,240,754.

BACKGROUND OF THE INVENTION

A number of types of apparatus and systems for recycling asphaltic concrete have been proposed. Included are those described in my U.S. Pat. Nos. 3,849,040, 3,999,743, and patents to others such as U.S. Pat. Nos. 4,075,710, 4,147,436 and 4,165,184. In these state of the art systems, the recycle material is introduced into an elongated rotating drum at the same end at which a burner introduces hot gases of combustion for heating the material, or at some point intermediate the ends of the drum. Thus, these systems have in common the more conventional method of gradually advancing the recycle material along the drum length in the same direction as the burner gases are directed. There is a disadvantage in using such an apparatus in heating asphaltic concrete which contain substantial amounts of asphalt "fines" which are easily burned when exposed to the high temperatures in the drum unless shielding or other equivalent means is incorporated to prevent overexposure of these small particles to the substantial heat. Alternatively, the recycle material is usually added downstream from the burner in a cooler drum zone. Although this latter method may be effective in preventing asphalt burning, it also substantially reduces the exposure of the asphaltic concrete to heating which may necessitate increased residence time within the drum or require super heating of the aggregate material at the hot end of the drum, in order to achieve the desired final product temperatures.

In U.S. Pat. No. 4,130,364 there is disclosed an apparatus for recycling asphaltic concrete by introducing the composition at the drum end opposite that at which the flame from the burner is introduced and advancing it toward the burner. The apparatus also requires a special flight installment so that a veil of composition is dropped through the center of the drum in the drum portion furthest from the burner, whereas in the drum portion nearest the drum burner, the composition is dropped to the side of center. In this apparatus, as well those previously noted, a common drawback is in venting the exhaust gases from the drum to atmosphere, or requiring treatment of such exhaust gases in conventional dust filtration and collection apparatus in an attempt to meet environmental pollution requirements. However, where the recycle asphaltic concrete is heated to temperatures above about 225° F., and commonly above 250° F. and higher, substantial amounts of volatile hydrocarbon gases and other asphaltic volatiles are given off by the hot asphalt, and which cannot be removed by such conventional exhaust gas treatment.

In my U.S. patent applications Ser. Nos. 871,351 filed Jan. 23, 1978, 906,734 filed May 17, 1978, and 139,709 filed April 14, 1980 there are disclosed improved methods of heating asphaltic concrete during recycling which burns these hydrocarbon volatiles within the drum prior to being vented to atmosphere. Moreover, in such apparatus the exhaust gas products are vented to atmosphere substantially only through the same port into which the burner directs flame and hot gases of combustion. Thus, these apparatus incorporate a substantially "closed end" drum system in the recycling process. Particularly in the latter patent application, where the recycle composition is introduced at the drum end opposite that at which the burner introduces flame, the system lends itself to apparatus scale up to handle continuous composition recycling quantities of say, 50 tons a hour, and up. Although such an apparatus offers the advantages of substantially increased production rates, while at the same time avoiding composition burning and degradation, but which burns the volatile asphaltic hydrocarbons prior to venting the exhaust gases to atmosphere, it is found that much heat is lost in the process. For example, the temperature of the exhaust gas vented to atmosphere in such an apparatus may be as high as 800° F., or more, which represents a substantial loss of energy. It is to the reduction of such energy loss, as well as the overall improvement of recycling processing that the present invention is directed.

SUMMARY OF THE INVENTION

The apparatus and system of this invention is designed to take special advantage of relatively high exhaust gas temperatures created in a drum into which flame and hot gases of combustion are directed. This is accomplished by incorporating a section of the drum beyond the burner nozzle in the direction of product advance or flow, and through which hot exhaust gases from the drum must pass prior to being vented to atmosphere. In the apparatus the burner nozzle is located between the two opposite ends of the drum, and particles of asphaltic concrete are introduced at one end, and advanced toward the burner, but in such a manner as to substantially prevent formation of a curtain of particles passing through the flame and hot gases of combustion. In the section of a drum between the burner and the output end the composition is alternately lifted and dropped to form a veil of particles passing through the hot exhaust gases.

DETAILED DESCRIPTION OF THE INVENTION

Figure 1:
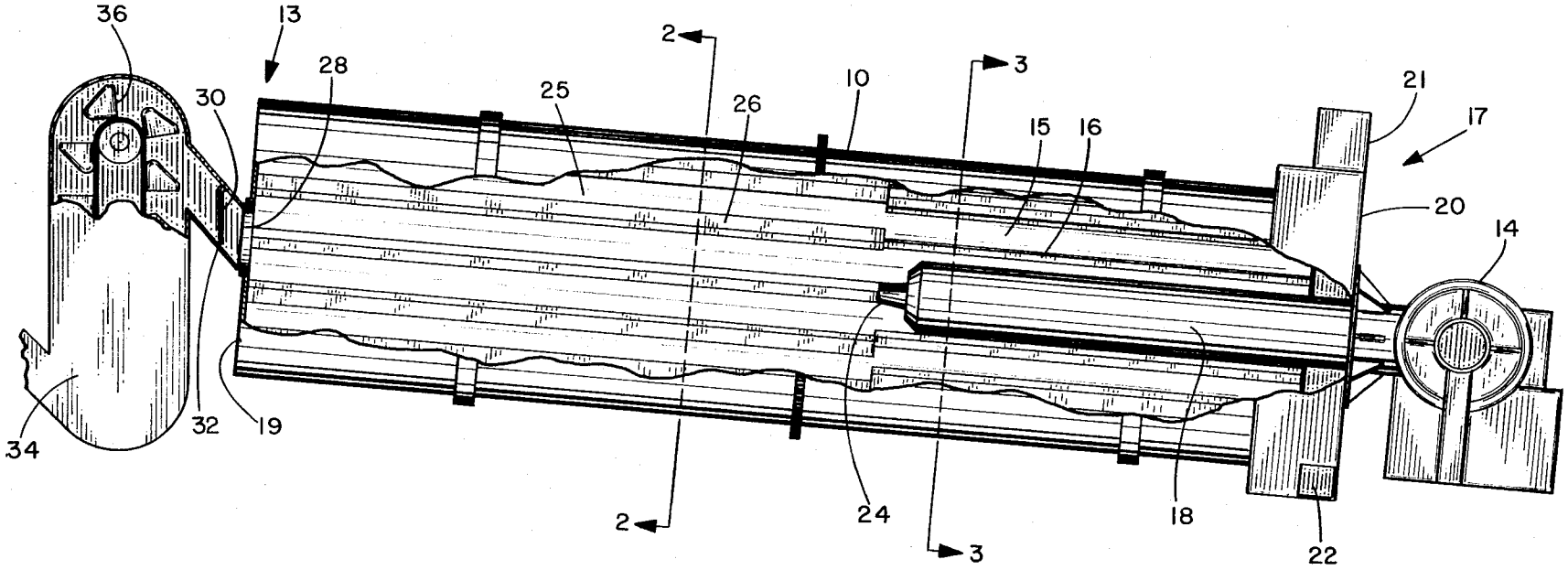
FIG. 1 is a side view of the apparatus of the invention partially cut away to show the interior of the drum.

In FIG. 1 there is illustrated the apparatus of the invention comprising a drum 10, a first end 13 in which composition is introduced, and a second end 17 at which the heated composition is recovered. In the first or input drum end 13, there is a port 28 into which composition is introduced, and means for maintaining the port in a closed condition except when composition is being introduced. In the specific apparatus shown, a bucket elevator 34 feeds composition at the input drum end, but this feed means is only for the purpose of illustration, and any suitable feeding means including conveyors, as well as hoppers, chutes, and the like may instead be used. In the embodiment shown, a chute 32 extends between port 28 and bucket elevator 34 through which composition is directed as buckets 36 pick up composition particles and drop them into the chute.

Closure means for port 28 comprises a hinged gate 30 which is normally in the closed condition as shown, but will swing open to the extent necessary to allow the composition to pass along the chute and fall gravitationally into the drum. The gate or other closure means need not be installed in the chute, but instead may be secured to the interior or exterior of end plate 19 to achieve substantially the same purpose.

At the opposite drum end 17 composition is recovered through port 22, conveniently located on cover 20 which extends around the open end of the drum. The purpose for the cover is to provide a shield for the otherwise open drum end. The cover includes a stack 21 through which the exhaust gases from the interior drum are vented directly to atmosphere. At the forward end of the drum there may also be incorporated a plate secured around its outer edge to the cylindrical drum end the plate having a plurality of openings through which composition is directed as the drum is rotated. The plate will also have a large central opening through which the burner extends. Such a plate is shown in my aforesaid co-pending application Ser. No. 139,709, filed April 14, 1980 the description of which is incorporated herein by reference. The openings in the plate may also include grates or other means for preventing larger chunks of the recycled composition from passing through.

Figure 3:
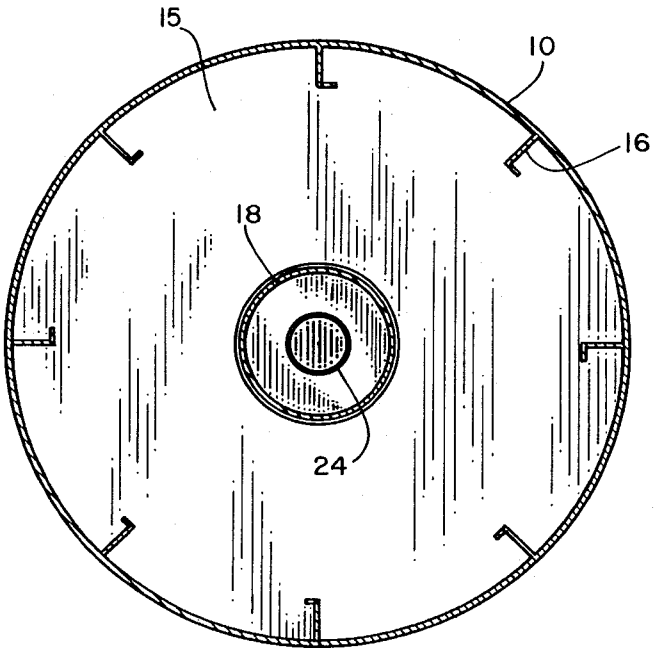
FIG. 3 is a view of the drum interior taken along lines 3—3 of FIG. 1.
Figure 2:
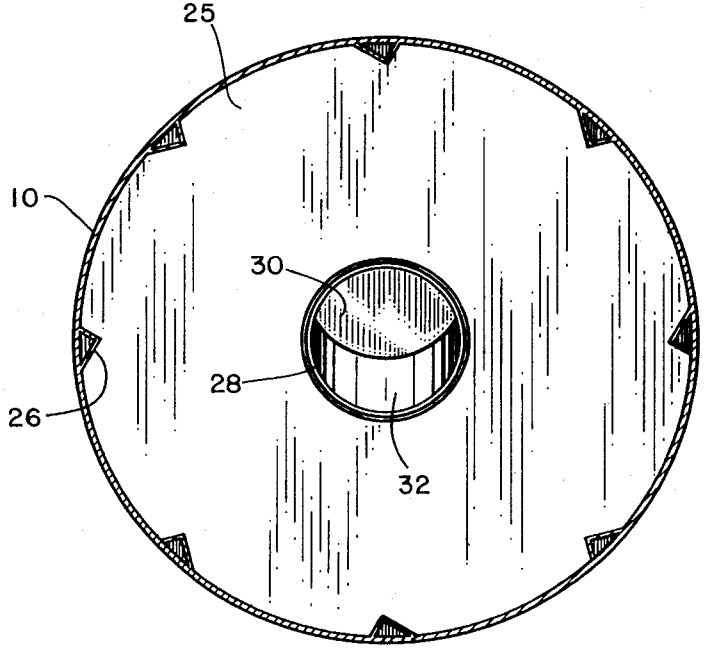
FIG. 2 is a view of the drum interior taken along lines 2—2 of FIG. 1.

Referring also to FIGS. 2 and 3, the apparatus of the invention comprises the drum which has two sections, a first drum section 25 and a second drum section 15. The first drum section extends between input drum end 13 and burner nozzle 24, and is characterized by rib lifters 26 positioned lengthwise along the drum interior. These type of lifters, unlike trays, do not carry the composition upwardly as the drum rotates to an extent whereby the composition creates a substantial curtain or veil of particles falling through the drum interior. Instead, the rib lifters allow the composition to become banked along the drum side and then cascade downwardly along the banked composition surface. Suitable rib lifters shown are lengths of angle iron secured along the drum interior to give an inverted V-shaped cross-section extending from the drum surface. Other similar lifters may be used, so long as they do not carry or lift significant amounts of composition past a 135° arc from the bottom center of the drum.

In the second drum end 15, the lifters 16 are of the tray-type by which the composition particles are held substantially longer than the rib lifters previously described, and from which trays the composition falls gravitationally from a substantially elevated position along the drum arc of rotation. Substantial amounts of composition are carried past the 135° arc before they fall from the tray surface. Thus, such tray-type lifters will cause the composition to fall freely through the drum interior thereby forming a curtain of composition through the hot exhaust gases in the drum. The drum is normally tilted somewhat so that the composition is gravitationally advanced from the input drum end to the opposite output end, and the lifters may also be slanted somewhat relative to the drum of axis rotation to assist in this composition advancement.

A burner 14 having appropriate blowers for directing primary, and preferably also secondary, air to enhance the burner flame, extends substantially into the drum, with burner nozzle 24 terminating between the two drum sections as previously described. Thus, the rib lifters 26 terminate at or adjacent the end of burner nozzle 24, and the ends of the tray-type lifters 15 begin at or near the same position. There may be some short overlap between the adjacent ends of these two different type lifters. The burner assembly also includes a shroud or cover 18 providing a channel for directing secondary air to the burner nozzle. The cover also acts as a shield for protecting the burner nozzle extending into the drum from particulate matter dropping through the drum in the second drum section.

Because of the unique features of the different lifter functions in the respective first and second sections of the drum, substantial increase in energy use efficiency and heating of the composition is achieved. In the first drum section 25, with the burner directing flame and hot gases of combustion directly into and along the length of that drum section, it is necessary to limit the direct exposure of small asphalt containing particles, particularly fines, those passing through a No. 8 U.S. series sieve and especially a No. 2 sieve and smaller, because of the danger of asphalt burning and degradation. Moreover, it is when these particles are initially heated from ambient temperatures to about 200° or 225° F. that the danger of asphalt burning is most significant. Accordingly, in the first drum section, where composition is initially heated, utilizing a lifter which will prevent formation of a substantial curtain of particles dropping through the drum interior, exposure of these small particles, high in asphalt content, can be minimized. Instead, in that section, with the angle iron lifters, or equivalent, the formation of such a curtain can be avoided, and instead, the composition will cascade along the side of the drum, as the drum is rotated, thereby exposing the surface of the composition to the hot gases, without allowing substantial amounts of separated particles from falling through the flame or hot gases. Thus, in the first section, heating will be gradual and degradation is minimized.

In the second drum section, since there is no flame directed into that section, and since the asphalt has become significantly heated so that the composition is much softer and semi-liquid there is substantially less danger of asphalt burning. However, exhaust gases which have temperatures sometimes exceeding about 800°, if vented directly to atmosphere, causes a significant loss in energy which could be utilized to heat composition. Accordingly, in the present invention, the composition is allowed to fall through these hot exhaust gases, behind the burner, thereby absorbing additional heat, which energy would otherwise be lost. Accordingly, in the second drum section, there is substantial increase in utilization of the hot gases for further heating composition up to temperatures as high as 300° or more, if desired, for the final product. A further advantage in the second section is in accomplishing additional mixing of the product, because of the tray-type lifters which fully elevate the product as the drum rotates and allowing it to drop gravitationally, thereby increasing homogeneity of the resulting product. Still another advantage is due to the increased temperature of the composition mixed in the second section, in which the asphalt has become more liquid and sticky, resulting in substantial reduction in dust from the recycling process directed to atmosphere. The dust which would otherwise be vented to atmosphere with the gases, thereby causing undesirable particulates in the exhaust gas effulent, is substantially reduced since the dust particles are captivated and held by the hot asphalt composition.

The apparatus of the present invention also offers the full advantage of the "closed end" drum apparatus as described in my aforesaid applications Ser. Nos. 871,351 and 906,734, thereby providing substantial burning in the drum of volatile hydrocarbons from the heated asphalt. Thus, rather than creating a substantial draft of exhaust gases from a burner, located at one end of the drum, flowing through the drum and exhausted at the opposite end, the present apparatus provides for venting of the exhaust gases only through a port at a drum end opposite from the direction in which the burner is directed. Again, this is accomplished because of the closure means associated with the input drum end which prevents the draft of exhaust gases being vented through the input port. The advantages of the apparatus described above, as well as others, and modifications of the apparatus within the purview of the invention, will be evident to those skilled in the art.

I claim:

1. An apparatus for treating asphalt-aggregate composition comprising:

an elongated rotatable drum having a first end and, as the only substantial opening thereat, a first port for introducing composition into said drum and closure means for closing said port except when composition is introduced, and a second end opposite said first end and and having a second port, open to atmosphere, for recovering composition and for venting substantially all hydrocarbon gases in the drum to atmosphere therethrough, and a burner having a nozzle located in said drum intermediate said first and second ends for directing hot gases of combustion toward said first end, wherein said drum interior comprises a first section between said first end and said nozzle having first means for lifting composition as the drum is rotated to prevent a curtain of particles passing through the hot gases of combustion in said first section, and a second section between said nozzle and said second end having second means for lifting composition as the drum is rotated to form a curtain of particles passing through hot gases in said second section.

2. The apparatus of claim 1 wherein said first lifting means comprises a plurality of inverted V-shaped ribs extending along the drum interior surface substantially parallel to the drum axis of rotation.

3. The apparatus of claim 2 wherein said second lifting means comprises a plurality of elongated trays.

4. A process for treating used asphaltic concrete composition comprising:

introducing particles of the composition into a first end of a rotating drum and advancing said particles to an opposite second end thereof, directing flame and hot gases of combustion in said drum toward said first end from a burner having a nozzle located intermediate said first and second ends, exposing said particles to said hot gases in a first portion of said drum between said first end and said burner nozzle in a manner preventing a curtain of said particles in said first position, and thereafter exposing said particles to said hot gases in a second portion of said drum between said burner nozzle and said second end in a manner forming a curtain of said particles through said hot gases.

5. The process of claim 4 wherein gases in said drum are substantially vented only from said second end.

6. The process of claim 4 wherein exhaust gases in said drum are substantially prevented from being vented at said first end.

* * * * *